US007278498B2

(12) United States Patent
Comacchio et al.

(10) Patent No.: US 7,278,498 B2
(45) Date of Patent: Oct. 9, 2007

(54) ROTATABLE SUPPORT FOR INCLINABLE MASTS OF DRILLING MACHINES

(75) Inventors: Renzo Comacchio, Riese Pio X (IT); Paqualino Comacchio, Riese Pio X (IT); Patrizio Comacchio, Riese Pio X (IT); Mohamad Ajami, Padova (IT)

(73) Assignee: Comacchio USA Corp., Miami, FL (US)

( * ) Notice: Subject to any disclaimer, the term of this patent is extended or adjusted under 35 U.S.C. 154(b) by 321 days.

(21) Appl. No.: 11/042,838

(22) Filed: Jan. 24, 2005

(65) Prior Publication Data

US 2006/0185904 A1 Aug. 24, 2006

(51) Int. Cl.
*E21B 7/02* (2006.01)

(52) U.S. Cl. ..... 175/122; 175/52; 173/28

(58) Field of Classification Search ..... None
See application file for complete search history.

(56) References Cited

U.S. PATENT DOCUMENTS

| | | | | |
|---|---|---|---|---|
| 4,074,774 | A * | 2/1978 | Brown et al. | 173/44 |
| 4,368,602 | A * | 1/1983 | Manten | 52/115 |
| 5,094,302 | A * | 3/1992 | Back | 173/28 |
| 5,794,723 | A * | 8/1998 | Caneer et al. | 175/85 |

* cited by examiner

*Primary Examiner*—Frank Tsay
(74) *Attorney, Agent, or Firm*—Egbert Law Offices

(57) ABSTRACT

The rotatable support for inclinable masts of drilling machines includes a connecting element connected to the lifting mechanism of a drilling machine, and including two essentially parallel planar elements having an essentially triangular or trapezoidal shape, on the vertex of which a coupling element configured for bearing the mast is connected. The coupling element is rotated by two pistons, and is coupled to the connecting element by two hinges having a common rotational axis and spaced one from the other, in order to allow the passage of the piston rods between the hinges.

6 Claims, 3 Drawing Sheets

ROTATABLE SUPPORT FOR INCLINABLE MASTS OF DRILLING MACHINES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This patent relates to the field of drilling machines for ground drilling, and in particular it concerns the supports for the masts of drilling machines.

BACKGROUND OF THE INVENTION

Drilling machines fit for obtaining vertical or inclined holes in the ground are known.

Said machines are provided with a drilling head that, through the dragger under the head, tows the drilling rod and the covering pipe, also known as jacket.

The drilling head is assembled on a carriage that slides on a vertical or inclinable guide-rail.

A cable or chain is connected, in the upper and in the lower part, with the carriage of the drilling head and slides on two pulleys positioned at the ends of the guide-rail. Said cable or chain is closed as a ring around the guide-rail, around the pulleys and around the carriage of the drilling head and is operated by a proper hydraulic motor and piston.

The sliding of said cable or chain causes the sliding of the carriage and of the drilling head along the guide-rail and consequently the lowering of the drilling head, in order to perform the drilling of the ground, or the lifting of said head in order to extract the drilling rod or in order to realize maintenance operations.

The assemblage of carriage, head, guide-rail is commonly called mast.

The mast, in turn, is constrained by the self-propelled carriage of the machine through a proper support that allows two inclinations:

the inclination of the mast around a horizontal axis perpendicular to the advance direction of the self-propelled carriage;

the rotation of the mast on an axis generically oriented towards the advance direction of the self-propelled carriage.

In short, the support allows the forward inclination of the mast, in order to perform vertical drillings in front of the self-propelled carriage, or inclined perforations in front of the self-propelled carriage even different from a horizontal direction, or the lateral rotation of the mast on the generically vertical plane perpendicular to the advance direction of the self-propelled carriage.

Some drilling machines are provided with a mast support that allows a small lateral translation of the mast itself.

The drilling machines are also provided with levers, mechanism or other device fit for lifting and lowering the mast support, and thus the mast itself, by a short amount.

In some field situations, due to the presence of obstacles and to ground configuration, it is not possible to properly position the self-propelled carriage but it is necessary to utilize supporting structures of the mast equipped on purpose in the site.

There are machines provided with devices for the rotation of the mast about its main axis.

Said machines have the support divided in two parts hinged one to the other on a vertical axis and rotated by two axial and opposed pistons without transmission levers.

The rotation of the mast on said vertical axis is limited at 20-25° on each side because the vertical hinge hinders the extendible rod of the thrusting piston.

When it is desirable to exceed said angle of rotation it is necessary to unconstrain one of the two stems in order to allow the other stem to rotate the system by about 90°.

Said unconstraining action causes a loss of stability and precision in the rotation of the system.

BRIEF SUMMARY OF THE INVENTION

In order to improve the use of said drilling machines, a new rotatable support for an inclinable mast of drilling machines capable of rotating the mast on the vertical axis of about ±90° and more without needing to unhook any extendible stem (also called rod) of the pistons has been studied and carried out.

An objective of the new support is to enabe the rotation of the mast on a generically vertical axis with both pistons stems functioning.

Another object, not less important, of the new support is to allow the rotation of the mast on said vertical axis by at least a right angle on each of said sides without needing any intervention on the assembly or coupling of the various parts.

These and other direct and complementary aims are achieved by the new support for mast comprising an element for the connection with the self-propelled carriage or with the lifting mechanism, a coupling element of the mast support, at least two oil-dynamic pistons.

The connecting element and the coupling element are shaped and hinged one to the other in a way that said coupling element can perform a rotation of at least ±90° around said hinge. In particular said coupling element rotates around a position aligned with the connecting element, of at least a right angle at each side.

The oil-dynamic pistons are connected with the connecting element and the coupling element in such a way to operate and control the rotation of the coupling element on the connecting element for its whole amplitude on each side.

The simultaneous action of both oil-dynamic pistons causes a precise and controlled rotation on both sides of the coupling element.

Rotatable support for inclinable masts of drilling machines comprising a connecting element, assembled on the back side, or anyway connected with the self-propelled carriage or with the lifting mechanism of the perforating machine on the front vertex of which a coupling element fit for bearing the mast, rotating by two oil-dynamic pistons always hinged on the coupling element and on the connecting element, is hinged, by two hinges spaced one from the other and with the same rotational axis. The distance between the two hinges is such to allow the passing between them of the extendible stems of each piston.

BRIEF DESCRIPTION OF THE SEVERAL VIEWS OF THE DRAWINGS

The characteristics of the new rotatable support for inclinable masts of drilling machines will be clarified by the following description, referring to the figures attached as a restrictive example.

DETAILED DESCRIPTION OF THE INVENTION

The new support (1) comprises a connecting element (C), a coupling element (A) and two pneumatic or oil-dynamic pistons (P).

Figure 4:
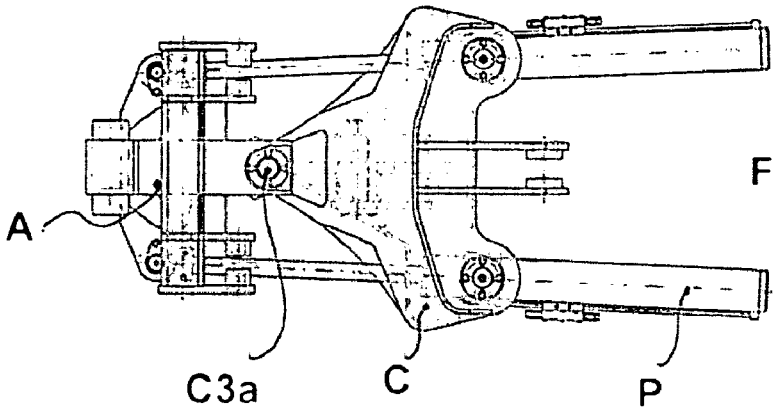
FIGS. 4, 5, 6, show top plan views of the three rotation positions of the mast (2) on the new support (1).
Figure 5:
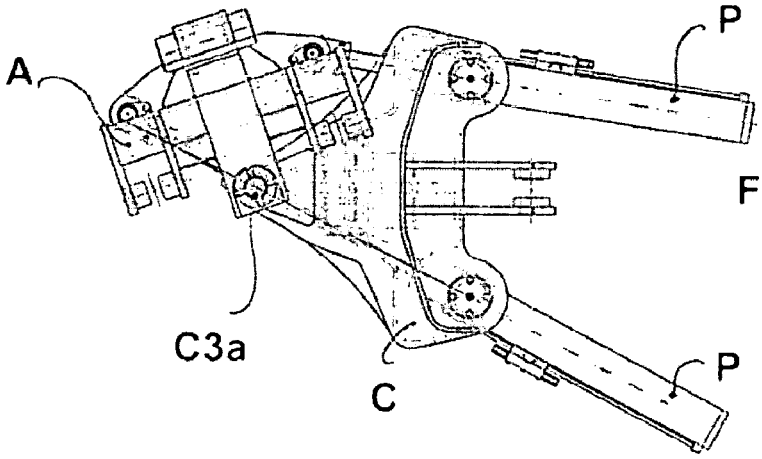
Figure 6:
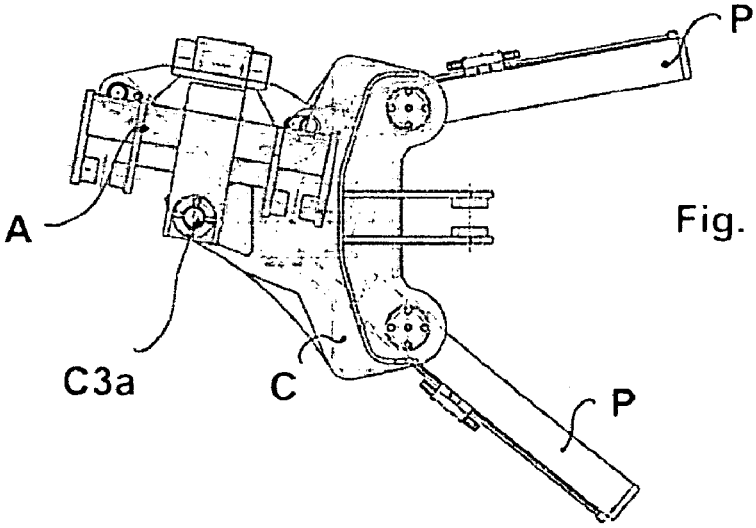

In particular in FIG. 4 the coupling element (A) is aligned with the connecting element (C), while in FIGS. 5 and 6 the coupling element (A) is rotated with respect to the connecting element (C).

The connecting element (C) comprises in its main parts two parallel and overlapped planar elements (C1*a*, C1*b*) with triangular or trapezoidal shape, or alike.

Said two planar elements (C1*a*, C1*b*) are connected one to the other in the back part of an appendix (C2) fit for fixing or uniting the new support (1) with the self-propelled carriage or with the lifting mechanism.

Said two planar elements (C1*a*, C1*b*) have in the front area two different hinges (C3*a*, C3*b*) that act as rotation pivots between the connecting element (C) and the coupling element (A).

Said two hinges (C3*a*, C3*b*) are overlapped, they have the same axis of rotation, and they are spaced one from the other in order to allow the passing of the elongation stem (P2) of the oil-dynamic pistons (P).

At the two sides, between said two planar elements (C1*a*, C1*b*), the fixed parts (P1), or external cylinders, or jackets of the two oil-dynamic pistons (P) are hinged.

The coupling element (A) is made of an element with a complex shape: the plan portion is generically cross-shaped, while the longitudinal vertical section is generically C-shaped.

The distance between the two ends (A1*a*, A1*b*) of the C-shaped element is such to allow the passing between them of the extendible stem (P2) of the oil-dynamic pistons (P).

Each of the two ends (A1*a*, A1*b*) of the C-shaped section of the coupling element (A) has a C-shaped seat fit for being coupled with each hinge (C3*a*, C3*b*) of the connecting element (C).

The central part (A2) of the C-shaped section of the coupling element (A), that is essentially vertical, is shaped or it has devices for the coupling and the vertical rotation of the masts (2) of drilling machines.

The extendible parts (P2) or stems of the oil-dynamic pistons (P) are hinged to the lateral ends (A3) of the C-shaped plan of the coupling element (A).

The new support (1) thus constituted is applied, through its connecting part (C), to the self-propelled carriage or to the lifting mechanism, while the mast (2) is connected or united to the coupling part (A) of the new support (1) itself.

FIGS. 5 and 6 show the rotation of the coupling part (A) on the connecting part (C) performed by both the oil-dynamic pistons (P).

Said figures represents two moments, intermediate position and limit position, of the rotation of the coupling part (A) on the connecting part (C) by both the oil-dynamic pistons (P).

Figure 1:
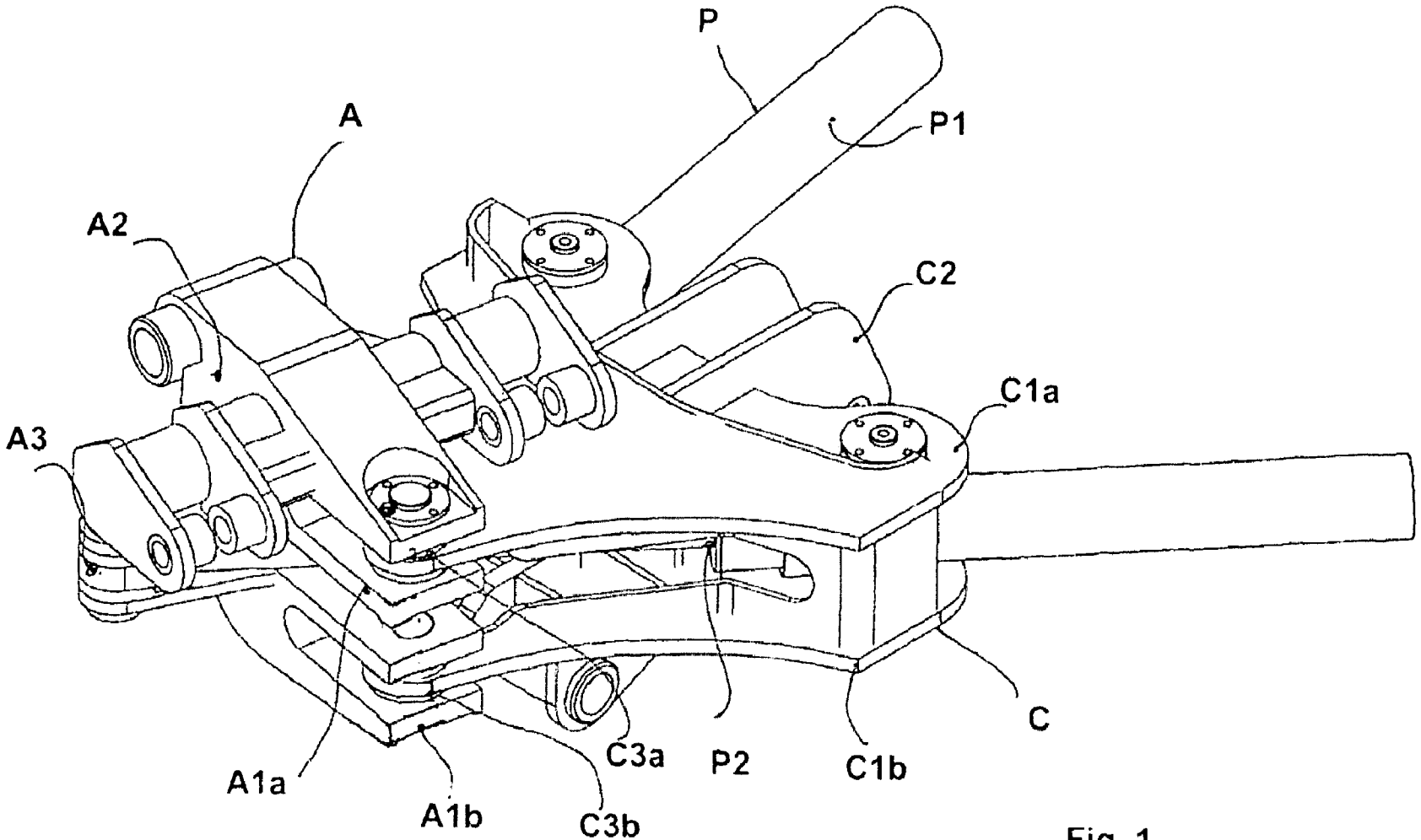
FIG. 1 shows an upper perspective view of the new support (1).
Figure 2:
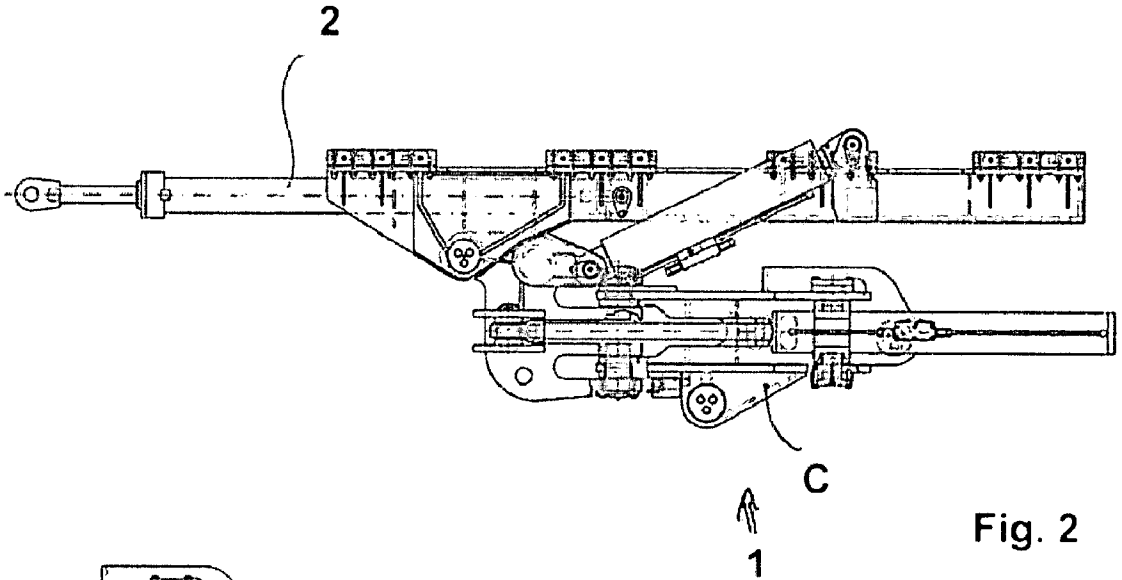
FIGS. 2 and 3 show two sectional views of the new support (1), of the mast (2) in the two positions, horizontal and vertical.
Figure 3:
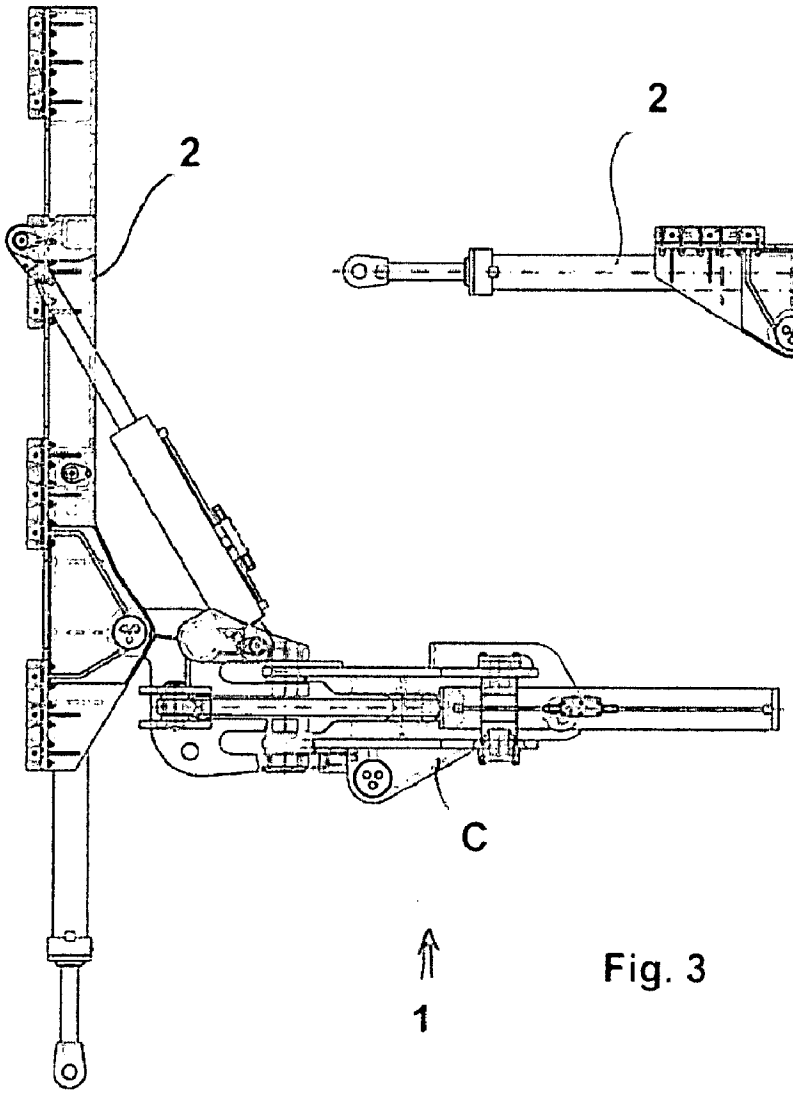

As it is possible to note also in FIG. 1, the extendible stem (P2) of the thrusting oil-dynamic piston (P) passes between the two rotation hinges (C3*a*, C3*b*) of the coupling part (A) on the connecting part (C).

In this way it is possible to rotate the coupling part (A) on the connecting part (C) of an angle of 90 and more degrees on each side without needing to detach the thrusting oil-dynamic piston (P) and without using levers or additional mechanisms.

The new support (1) for masts (2) thus constituted allows the use of both oil-dynamic pistons (P) for the entire rotation of the coupling part (A), or of the mast (2), on the vertical axis.

The new support (1) allows to control the rotation of the coupling part (A) and of the mast (2) during its entire amplitude on each side.

The new support (1) allows the rotation of the coupling part (A) and of the mast (2) on the entire amplitude without needing to detach or anyway uncouple one of the oil-dynamic pistons (P).

With reference to the above description the following claims are put forth.

We claim:

1. A rotatable support for an inclinable mast of a drilling machine comprising:

a connecting element connected with a lifting device of the drilling machine, the connecting element comprising two essentially parallel planar members coupled and spaced apart one from the other; and a coupling element configured for bearing a mast, the coupling element comprising two opposing coupling members connected one to the other, the coupling element being rotatable in relation to the connecting element by the action of a plurality of pistons each connected to the coupling element by a piston rod, wherein the connecting element and the coupling element are coupled one to the other with a plurality of hinges having a common rotational axis, and wherein the plurality of hinges are spaced one from the other along the common rotational axis, each of the hinges coupling one of the essentially parallel planar members with one of the coupling members, thereby enabling the passage of the piston rods therebetween.

2. The rotatable support of claim 1, wherein the essentially parallel planar members each have an essentially triangular or trapezoidal shape including a base and an apical portion, wherein appendices extend from the base of at least one of the essentially parallel planar members, each of the appendices coupling one of the pistons with at least one of the essentially parallel planar members, and wherein the hinges are situated in the apical portion.

3. The rotatable support of claim 1, wherein the coupling element has an essentially cross-shaped configuration including a first and a second arms, wherein the coupling members each have an essentially C-shape and are perpendicularly aligned the first arm, wherein the extremities of the C-shape are connected to one of the hinges, and wherein the central part of the C-shape is coupled with the second arm, the second arm being connected to the inclinable mast.

4. The rotatable support of claim 1, wherein each of the pistons includes a jacket housing the piston, wherein each of the pistons is coupled to one of the appendices by coupling the jacket to one of the appendices, and wherein each of the piston rods is connected to the coupling element by connecting the piston rod to a member connecting the central parts of the C-shapes.

5. The rotatable support of claim 1, wherein, in an at rest position, the longitudinal axes of the pistons converge.

6. The rotatable support of claim 1, wherein the pistons are oil or pneumatically actuated.

* * * * *